US005278910A

United States Patent [19]

Suzuki et al.

[11] Patent Number: 5,278,910

[45] Date of Patent: Jan. 11, 1994

[54] APPARATUS AND METHOD FOR SPEECH SIGNAL LEVEL CHANGE SUPPRESSION PROCESSING

[75] Inventors: Ryoji Suzuki, Nara; Masayuki Misaki, Kobe, both of Japan

[73] Assignee: Matsushita Electric Industrial Co., Ltd., Osaka, Japan

[21] Appl. No.: 748,190

[22] Filed: Aug. 20, 1991

[30] Foreign Application Priority Data

Sep. 7, 1990 [JP] Japan ..... 2-237513

[51] Int. Cl.[5] ..... G10L 5/00

[52] U.S. Cl. ..... 381/41; 395/2; 395/2.4; 395/2.8; 364/724.01; 364/724.12; 364/728.01

[58] Field of Search ..... 381/31, 37, 41, 45, 381/46, 47; 392/2; 364/724.16, 728.01, 728.03, 715.07, 724.01, 724.12

[56] References Cited

U.S. PATENT DOCUMENTS 4,389,540 6/1983 Nakamura et al. ..... 381/41
4,587,620 5/1986 Niimi et al. ..... 364/724.01
4,852,169 7/1989 Veeneman et al. ..... 381/41
4,935,963 6/1990 Jain ..... 381/31

OTHER PUBLICATIONS

"Consonant Burst Enhancement: A Possible Means to Improve Intelligibility for the Hard of Hearing", R. W. Guelke, Veterans Admins.; Journal of Rehabilitation Research & Development vol. 24, No. 4, pp. 217–220.

*Primary Examiner*—Dale M. Shaw
*Assistant Examiner*—Kee M. Tung
*Attorney, Agent, or Firm*—Wenderoth, Lind & Ponack

[57] ABSTRACT

A level measuring circuit first measures a level of an input speech signal. Next, a coefficient calculating circuit determines a value for suppressing a change of the level of the input speech signal on the basis of an output of the level measuring circuit. Then an input speech signal delay circuit delays the input speech signal by a time required for processing in the level measuring circuit and the coefficient calculating circuit. Finally a multiplying circuit multiplies an output of the input speech signal delay circuit by an output of the coefficient calculating circuit to obtain an output speech signal in which changes in level of the input speech signal are suppressed.

11 Claims, 3 Drawing Sheets

APPARATUS AND METHOD FOR SPEECH SIGNAL LEVEL CHANGE SUPPRESSION PROCESSING

BACKGROUND OF THE INVENTION

1. Field of the Invention

The present invention relates to an apparatus for speech signal processing and a method for speech signal processing intended to improve the intelligibility of speech signals in a hearing aid or a public address system.

2. Description of the Prior Art

Hitherto there has been much study directed to the speech signal processing apparatus for the purpose of improving intelligibility for the hard of hearing, of such an example being disclosed by R. W. GUELKE in "Consonant burst enhancement: A possible means to improve intelligibility for the hard of hearing," Journal of Rehabilitation Research and Development, Vol. 24, No. 4, Fall 1987, pp. 217–220.

In such a conventional apparatus for speech signal processing, the input speech signal is first fed into a gap detector, an envelope follower, and a zero crossing detector. Next, the burst of the stop consonant is detected by the gap detector, envelope follower, differentiator, and zero crossing detector. In response consequence, a the one-shot multivibrator delivers pulses for a specific interval corresponding to the burst of the stop consonant to an amplifier. Finally, the amplifier amplifies the input speech signal by a specific amplification factor for the duration of the interval of the pulses delivered by the one-stop multivibrator.

In such a prior art arrangement, it is difficult to detect the burst of the stop consonant, and it is particularly difficult when noises are superposed. Further, only the stop consonant can be enhanced, and many other consonants cannot be enhanced. Still further, since the interval to be amplified and the amplification factor are constant, it is impossible to follow up changes.

SUMMARY OF THE INENTION

It is hence a primary object of the invention to present an apparatus for speech signal processing and a method for speech signal processing which is capable of stably improving the intelligibility of speech using a relatively simple processing technique.

To achieve the above object, a speech signal processing apparatus of the invention comprises level measuring means for measuring a level of an input speech signal, coefficient calculating means for determining a coefficient which becomes a large value when a level of the input speech signal at a specific time is smaller than levels before and after the specific time and a small value when larger on the basis of an output of the level measuring means, input speech signal delay means for delaying the input speech signal for compensating for a processing delay due to the level measuring means and coefficient calculating means, and multiplying means for multiplying an output of the input speech signal delay means by an output of the coefficient calculating means.

In this constitution, as the multiplying means multiplies the output of the input speech signal delay means by the output of the coefficient calculating means, changes of the level of the input speech signal in the course of time are decreased and temporal masking is avoided. Therefore, masking of a signal of small level such as a consonant by a signal of large level such as vowel is prevented, and the intelligibility is improved. At the same time, sudden level changes are suppressed, so that the pulsive noise can be suppressed.

The coefficient calculating means comprises level memory means for sequentially storing values of the output of the level measuring means at the specific time and before and after the specific time, coefficient memory means for storing coefficients for calculating a value for suppressing a level change of the input speech signal, convolutional operation means for performing a convolutional operation between contents of the level memory means and contents of the coefficient memory means, and dividing means for dividing an output of the convolutional operation means by a content at the specific time of the contents stored in the level memory means. In this constitution, by utilizing the memory content of the coefficient memory means as the characteristic for differentiating the level of the input speech signal in two stages with respect to the time axis, the value for smoothing the level of the input speech signal can be easily determined.

The level measuring means comprises absolute value means for determining an absolute value of the input speech signal, absolute value memory means for sequentially storing values of an output of the absolute value means, integral coefficient memory means for storing coefficients for calculating the level of the input speech signal, and convolutional operation means for performing a convolutional operation between contents of the absolute value memory means and contents of the integral coefficient memory means. In this constitution, by utilizing the content of the integral coefficient memory means as the characteristic for integrating the absolute value of the input speech signal with respect to the time axis, the level of the input speech signal can be measured easily and accurately.

DESCRIPTION OF THE PREFERRED EMBODIMENTS

Figure 1:
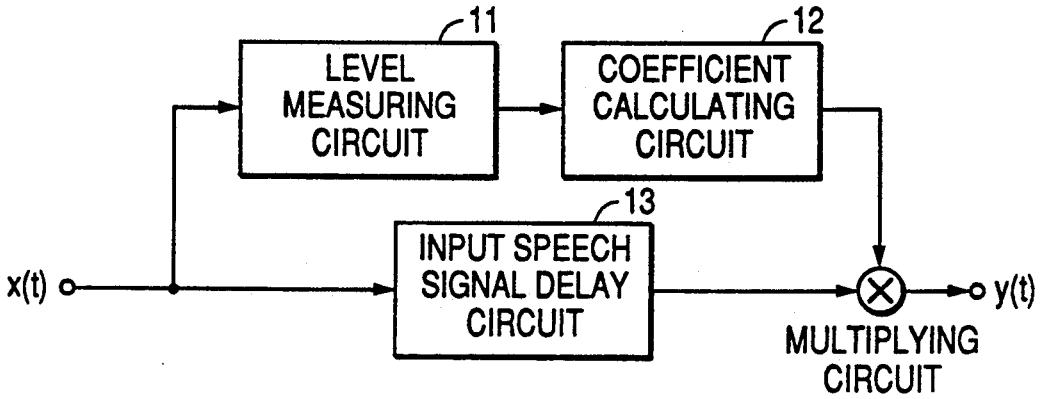
FIG. 1 is a block diagram of a speech signal processing apparatus in an embodiment of the invention.

FIG. 1 shows a constitution of a speech signal processing apparatus in an embodiment of the invention.

In FIG. 1, numeral 11 denotes a level measuring circuit, 12 denotes a coefficient calculating circuit, 13 denotes an input speech signal delay circuit, and 14 denotes a multiplying circuit. The level measuring circuit 11 measures the level of the input speech signal. Consequently, the coefficient calculating circuit 12 determines a value for suppressing the level change of the input speech signal on the basis of the outputs of the level measuring circuit 11 at a specific time and before and after the specific time. The input speech signal delay circuit 13 delays the input speech signal by the time required for processing in the level measuring circuit 11 and coefficient calculating circuit 12. Finally, the multiplying circuit 14 multiplies the output of the input speech signal delay circuit 13 by the output of the coefficient calculating circuit 12, thereby obtaining an output speech signal.

Figure 2:
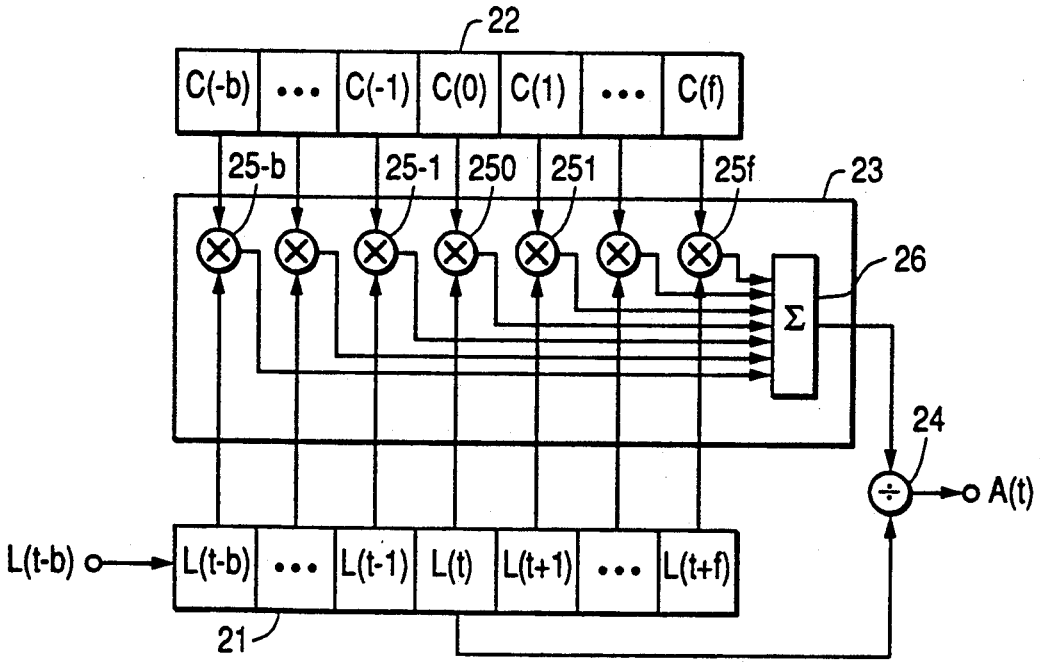
FIG. 2 is a block diagram of a coefficient calculating circuit of the speech signal processing apparatus in an embodiment of the invention.

FIG. 2 shows an example of the constitution of the coefficient calculating circuit 12. In FIG. 2, numeral 21 denotes a level memory circuit, 22 denotes a coefficient memory circuit for storing coefficients for calculating a value for suppressing the level change of the input speech signal, 23 denotes a convolutional operation circuit, 24 denotes a dividing circuit, 25*i* (i=−b to +f) denotes a multiplying circuit group, and 26 denotes a summation circuit. The level memory circuit 21 stores the outputs of the level measuring circuit 11 at a specific time t and before and after the specific time t (t−b to t+f). The convolutional operation circuit 23 performs a convolutional operation between the contents of the level memory circuit 21 and the contents of the coefficient memory circuit 22. The dividing circuit 24 divides the output of the convolutional operation circuit 23 by the content L(t) at time t for suppressing the level change of the input speech signal out of the contents stored in the level memory circuit 21, and delivers the value A(t) for suppressing the level changes of the input speech signal at time t. The multiplying circuit group 25*i* integrates the contents of the coefficient memory circuit 22 and the contents of the level memory circuit 21, and the summation circuit 26 determines the sum of the outputs of the multiplying circuit group 25*i*.

Figure 3:
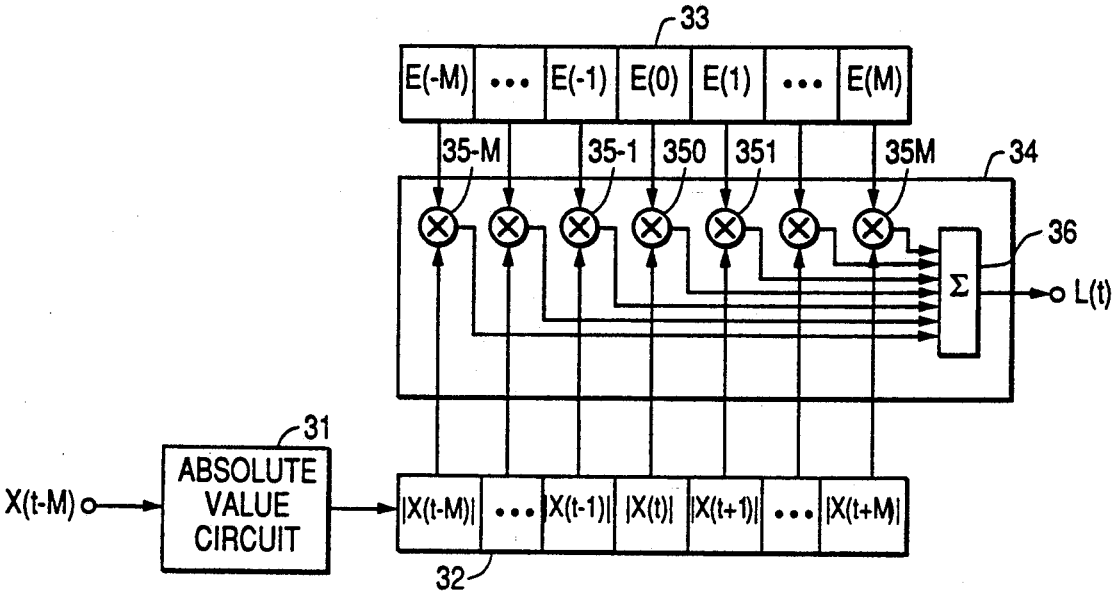
FIG. 3 is a block diagram of a level measuring circuit of the speech signal processing apparatus in an embodiment of the invention.

FIG. 3 shows an example of the constitution of the level measuring circuit 11 of the speech signal processing apparatus in an embodiment of the invention. In FIG. 3, numeral 31 denotes an absolute value circuit, 32 denotes an absolute value memory circuit, 33 denotes an integral coefficient memory circuit for storing coefficients for smoothing the absolute value of the level of the input speech signal, 34 denotes a convolutional operation circuit, 35*i* (i=−M to +M) denotes a multiplying circuit group, and 36 denotes a summation circuit. The absolute value circuit 31 determines the absolute value of the input speech signal x(t−M). The absolute value memory circuit 32 stores the outputs of the absolute value circuit 31 at a specific time t and before and after the specific time t (t−M to t+M). The convolutional operation circuit 34 performs a convolutional operation between the contents of the absolute value memory circuit 32 and the contents of the integral coefficient memory circuit 33, and delivers the level L(t) of the input speech signal at time t. The multiplying circuit group 35*i* integrates the contents of the integral coefficient memory circuit 33 and the contents of the absolute value memory circuit 32, and the summation circuit 36 determines the sum of the outputs of the multiplying circuit group 35*i*.

Figure 4A:
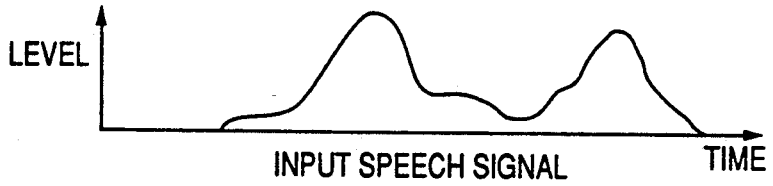
FIGS. 4(*a*) and 4(*b*) are signal waveform diagrams of an input speech signal and output speech signal of the speech signal processing apparatus in an embodiment of the invention.
Figure 4B:
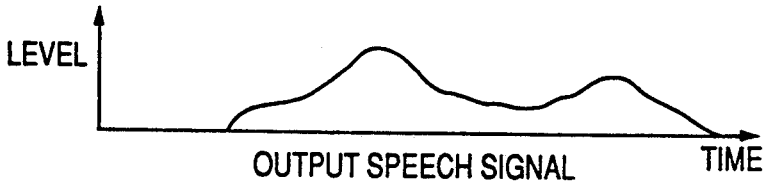

FIG. 4 shows examples of the input speech signal level and the output speech signal level of the speech signal processing apparatus in an embodiment of the invention. FIG. 4(*a*) represents the level of the input speech signal, and FIG. 4(*b*) indicates the level of the output speech signal. In the portion where the level of the input speech signal is lower than the levels before and after the portion in time, the level of the output speech signal is raised, and in the portion where the level of the input speech signal is higher than the levels before and after the portion in time, the level of the output speech signal is lowered, so that the level changes of the input speech signal can be suppressed in the output speech signal.

Thus, according to the embodiment as shown in FIG. 1, the coefficient calculating circuit 12 determines the value for suppressing the level changes of the input speech signal depending on the outputs of the level measuring circuit 11 at the specific time and before and after the specific time, and the multiplying circuit 14 multiplies the output of the input speech signal delay circuit 13 by the output of the coefficient calculating circuit 12, thereby suppressing the level changes of the input speech. Therefore masking of a small level such as consonant by a large level signal such as vowel can be prevented, so that the intelligibility can be improved. Moreover, since the sudden changes of the level are suppressed, pulsive noise can be suppressed.

Figure 5:
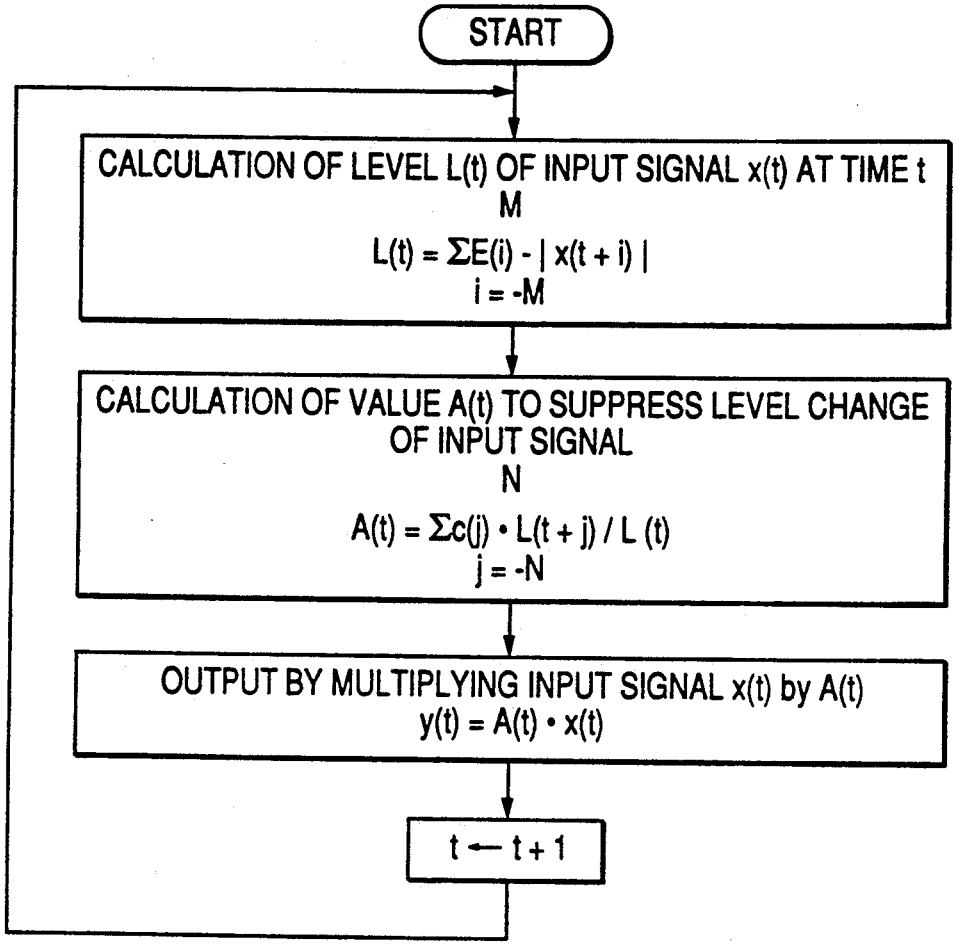
FIG. 5 is a flow chart of a speech signal processing method in an embodiment of the invention.

FIG. 5 is a flow chart of a speech signal processing method in an embodiment of the invention.

Its operation is described below.

In the first place, the level measuring circuit 11 determines the level L(t) of the input speech signal x(t) at time t, from the input speech signal at time t and points M before and after time t as shown in equation (1).

$$L(t) = \sum_{i=-M}^{M} E(i) \cdot |x(t+i)| \tag{1}$$

in which $|\cdot|$ denotes operation for determining absolute value and in which E(i) denotes a coefficient for determining the level of input speech signal (to be described later).

Next, the coefficient calculating circuit 12 determines the value A(t) for suppressing the level changes of the input speech signal at time t, from the levels at time t and points N before and after time t as shown in equation (2).

$$A(t) = \sum_{j=-N}^{N} C(j) \cdot L(t+j)/L(t) \tag{2}$$

where C(j) is a coefficient for determining the value A(t) for suppressing the level changes of the input speech signal (to be described later).

Consequently, the multiplying means 14 obtains the output speech signal y(t) by multiplying the input speech signal x(t) by A(t) as shown in equation (3).

$$y(t)=A(t)\cdot x(t) \tag{3}$$

Afterwards, updating the time t, the same processing is repeated.

Figure 6:
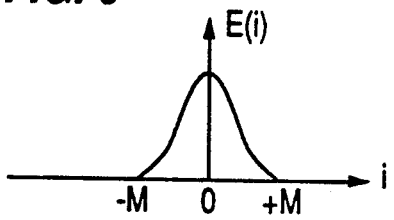
FIG. 6 is a characteristic diagram of coefficient E(i) of the speech signal processing method in an embodiment of the invention.

FIG. 6 shows the characteristic of the coefficient E(i) for determining the level of input speech signal. By convoluting this characteristic into the absolute value of the input speech signal, the absolute value of the input speech signal is smoothed, and the level of the input speech signal may be determined. The coefficient E(i) is shown in equation (4).

$$E(i)=k_n \cdot \exp(-i^2/2\sigma_{n2}) \quad (4)$$

in which $k_n$, $\sigma_n$ are constants.

As the coefficient E(i), aside from equation (4), the characteristic of integrating the level of the input speech signal with respect to the time axis, or the characteristic of gradually decreasing the amplitude of the peripheral parts with respect to the middle of the time axis may be possible, and similar effects are brought about in either case.

In the coefficient E(i), meanwhile, in order to prevent level changes in the portion where the level of the input speech signal is not changed (the stationary portion), the constants $k_n$ and $\sigma_n$ are set so as to satisfy the conditions in equation (5).

$$\sum_{i=-M}^{M} E(i) = 1 \quad (5)$$

Figure 7:
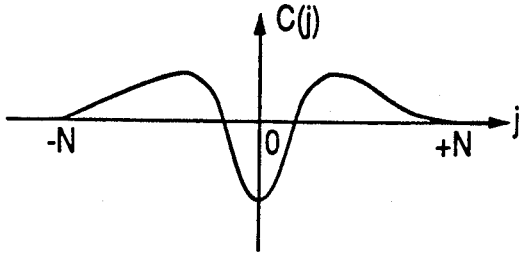
FIG. 7 is a characteristic diagram of coefficient C(j) of the speech signal processing method in an embodiment of the invention.

FIG. 7 shows the characteristic of the coefficient C(j) for determining the value A(t) for suppressing the level changes of the input speech signal. By convoluting this characteristic into the level of the input speech signal, when the levels before and after the specific time are larger than the level of the input speech signal at the specified time, the convolution result becomes larger, and when the level before and after the specific time is smaller than the level at the specified time, the convolution result becomes smaller. Therefore, by multiplying this value A(t) by the input speech signal x(t) as shown in equation (3), the level of the input speech signal is smoothed. The coefficient C(j) is shown in equation (6).

$$C(j)=k_e \cdot \exp(-j^2/2\sigma_{e2})-k_i \cdot \exp(-j^2/2\sigma_{i2}) \quad (6)$$

in which $k_e$, $k_i$, $\sigma_e$, $\sigma_i$ are constants;

$k_e < k_i$, $\sigma_e > \sigma_i$

As the coefficient C(j), aside from equation (6), the characteristic of differentiating the level of the input speech signal in two stages with respect to the time axis, or the characteristic of concave amplitude in the middle part with respect to the peripheral part of the time axis may be possible, and similar effects are brought about in either case.

In the coefficient C(j), meanwhile, in order to prevent level changes in the portion where the level of the input speech signal is not changed (the stationary portion), the constants $k_e$, $k_i$, $\sigma_e$, $\sigma_i$ are set so as to satisfy the condition of equation (7).

$$\sum_{j=-N}^{N} C(j) = 1 \quad (7)$$

where $k_e$, $k_i$, $\sigma_e$, $\sigma_i$ are constants, but they may be also variables changing with the time.

Thus, according to the embodiment, level changes of the input speech signal are suppressed by determining the value A(t) for suppressing the level changes of the input speech signal on the basis of the values of the level L(t) of the input speech signal at the specified time and the time before and after specified time, and multiplying A(t) by the input speech signal. Therefore, masking of a small level signal such as consonant by a large level signal such as vowel can be prevented, and the intelligibility can be improved. Furthermore, since sudden changes of the signal level are suppressed, the pulsive noise can be suppressed.

What is claimed is:

1. A speech signal processing apparatus comprising: input means for receiving an input speech signal; and, suppressing means for suppressing a signal level change of said input speech signal, said suppressing means including (a) coefficient calculating means having a first memory for storing successive signal levels of said input speech signal in a predetermined period of time, a second memory for storing coefficients for differentiating the level of said input speech signal in two stages, and a convolution operation means for performing a convolution operation between contents of said first memory and contents of said second memory to obtain a correction value, and (b) multiplying means for multiplying said input speech signal by said correction value to thereby suppress the signal level change of said input speech signal.

2. A speech signal processing apparatus comprising: input means for receiving an input speech signal; level measuring means for measuring a signal level of said input speech signal; and, suppressing means for suppressing a signal level change of said input speech signal, said suppressing means including (a) coefficient calculating means having a first memory for storing successive signal levels of said input speech signal in a predetermined period of time, a second memory for storing coefficients for differentiating the level of said input speech signal in two stages, and a convolution operation means for performing a convolution operation between contents of said first memory and contents of said second memory to obtain a correction value, (b) delay means for delaying said input speech signal for a time corresponding to the operation of said coefficient calculating means to obtain a delayed speech signal, and (c) multiplying means for multiplying said delayed speech signal by said correction value to thereby suppress the signal level change of said input speech signal.

3. An apparatus as recited in claim 2, wherein said level measuring means includes: absolute value means for determining an absolute value of said input speech signal; absolute value memory means for sequentially storing absolute values determined by said absolute value means; integral coefficient memory means for storing coefficients for calculating a signal level of said input speech signal; and, convolution operation means for performing a convolution operation between contents of said absolute value memory means and said integral coefficient memory means.

4. An apparatus as recited in claim 3, wherein said integral coefficient memory means stores as said coefficients a characteristic for integrating said absolute value of said input speech signal with respect to time.

5. An apparatus as recited in claim 3, wherein said integral coefficient memory means stores as said coefficients a characteristic for gradually increasing an amplitude of a middle part with respect to a peripheral portion of a time axis of said input speech signal.

6. An apparatus as recited in claim 3, wherein said integral coefficient memory means stores a coefficient E(i) expressed in accordance with the following equation:

$$E(i)=k_n \cdot \exp(-i^2/2\sigma_{n2})$$

where i denotes a position in said integral coefficient memory means, and wherein $k_n$, $\sigma_n$ denote constants.

7. A speech signal processing apparatus comprising:

input means for receiving an input speech signal;

level measuring means for measuring a signal level of said input speech signal; and, suppressing means for suppressing a signal level change of said input speech signal, said suppressing means including (a) first memory means for sequentially storing signal level values measured by said level measuring means, (b) second memory means for storing coefficients for calculating a value for suppressing a signal level change of said input speech signal, (c) convolutional operation means for performing a convolutional operation between contents of said first memory means and contents of said second memory means, (d) dividing means for dividing an output of said convolutional operation means by a content associated with a specific time of contents stored in the level memory means to obtain a correction value, (e) delay means for delaying said input speech signal for a time corresponding to the operation of said suppressing means to obtain a delayed speech signal, and (f) multiplying means for multiplying said delayed speech signal by said correction value to there-by suppress the signal level change of said input speech signal.

8. An apparatus as recited in claim 7, wherein said second memory means stores as said coefficients a characteristic for differentiating the signal level of said input speech signal in two stages with respect to time.

9. An apparatus as recited in claim 7, wherein said second memory means stores as said coefficients a characteristic for a concave amplitude in a middle part with respect to peripheral parts of a time axis of said input speech signal.

10. An apparatus as recited in claim 7, wherein said second memory means stores a coefficient C(j) expressed in accordance with the following equation:

$$C(j)=k_e \cdot \exp(-j^2/2\sigma_{e2})-k_i \cdot \exp(-j^2/2\sigma_{i2})$$

where j denotes a position in said second memory means, where $k_e$, $k_i$, $\sigma_e$, $\sigma_i$ denote constants, and where $k_e < k_i$, $\sigma_e > \sigma_i$.

11. An apparatus as recited in claim 7, wherein a value A(i) for suppressing the signal level change of said input speech signal is calculated in accordance with the following equation:

$$A(t) = \frac{\sum_{j=-b}^{f} C(j) \cdot L(t+j)}{L(t)}$$

where t denotes time; where f, −b denote constants; where C(j) denotes the j-th content of predetermined coefficients; and where L(t) denotes the signal level of said input speech signal at time t.

* * * * *